US009238948B2

(12) United States Patent
Gray

(10) Patent No.: US 9,238,948 B2
(45) Date of Patent: Jan. 19, 2016

(54) SYSTEM FOR ANALYSING GAS FROM STRATA BEING DRILLED UNDER HIGH MUD FLOWS

(76) Inventor: Ian Gray, Coorparoo (AU)

( * ) Notice: Subject to any disclaimer, the term of this patent is extended or adjusted under 35 U.S.C. 154(b) by 630 days.

(21) Appl. No.: 13/510,317

(22) PCT Filed: Nov. 19, 2010

(86) PCT No.: PCT/AU2010/001549
§ 371 (c)(1),
(2), (4) Date: May 17, 2012

(87) PCT Pub. No.: WO2011/060494
PCT Pub. Date: May 26, 2011

(65) Prior Publication Data

US 2012/0217065 A1 Aug. 30, 2012

(30) Foreign Application Priority Data

Nov. 19, 2009 (AU) ..... 2009905663

(51) Int. Cl.
*E21B 21/06* (2006.01)
*E21B 21/01* (2006.01)
*E21B 49/00* (2006.01)

(52) U.S. Cl.
CPC ..... *E21B 21/01* (2013.01); *E21B 21/067* (2013.01); *E21B 49/005* (2013.01)

(58) Field of Classification Search
CPC ..... E21B 21/01; E21B 49/005; E21B 21/067
USPC ..... 175/46, 50, 207, 206; 166/267, 357
See application file for complete search history.

(56) References Cited

U.S. PATENT DOCUMENTS

| | | | | |
|---|---|---|---|---|
| 4,342,222 | A | 8/1982 | Alekhin et al. | |
| 5,274,552 | A | 12/1993 | Milburn | |
| 5,337,838 | A | 8/1994 | Sorensen | |
| 5,785,131 | A * | 7/1998 | Gray | 175/46 |
| 6,311,986 | B1 | 11/2001 | Richardson et al. | |
| 6,443,001 | B1 | 9/2002 | Duriez et al. | |
| 2003/0168391 | A1 * | 9/2003 | Tveiten | 210/188 |
| 2004/0031622 | A1 | 2/2004 | Butler et al. | |
| 2007/0169540 | A1 * | 7/2007 | Sterner et al. | 73/19.09 |
| 2008/0115971 | A1 * | 5/2008 | Kelleher et al. | 175/5 |
| 2008/0190668 | A1 * | 8/2008 | Swartout | 175/207 |
| 2008/0257032 | A1 | 10/2008 | Zollo et al. | |
| 2008/0266577 | A1 * | 10/2008 | Prouvost et al. | 356/626 |
| 2010/0307830 | A1 * | 12/2010 | Curlett | 175/61 |

FOREIGN PATENT DOCUMENTS

| | | | |
|---|---|---|---|
| GB | 2242373 | 10/1991 | |
| SU | 422843 | 4/1974 | |
| WO | WO 2008144096 A1 * | 11/2008 | E21B 7/18 |

* cited by examiner

*Primary Examiner* — Jennifer H Gay
*Assistant Examiner* — David Carroll
(74) *Attorney, Agent, or Firm* — Roger N. Chauza, PC

(57) ABSTRACT

A gas analysis system for determining the gas content of subterranean strata. A boring operation is commenced to form a borehole into or through a subterranean formation, such as a coal or shale formation to determine the gas content thereof. The drill fluid, cuttings and any desorbed gas is carried from the downhole location to surface analysing equipment in a closed system, so that the desorbed gases are not exposed to the air. The drill stem is capped or sealed at the surface, as well as the wellbore annulus to effectively seal the drill liquid, cuttings and desorbed gasses. The drill fluid, cuttings and desorbed gasses from the formation are coupled from the wellhead apparatus to the gas processing equipment via a closed system so that the constituents and volume of the gas can be determined.

17 Claims, 1 Drawing Sheet

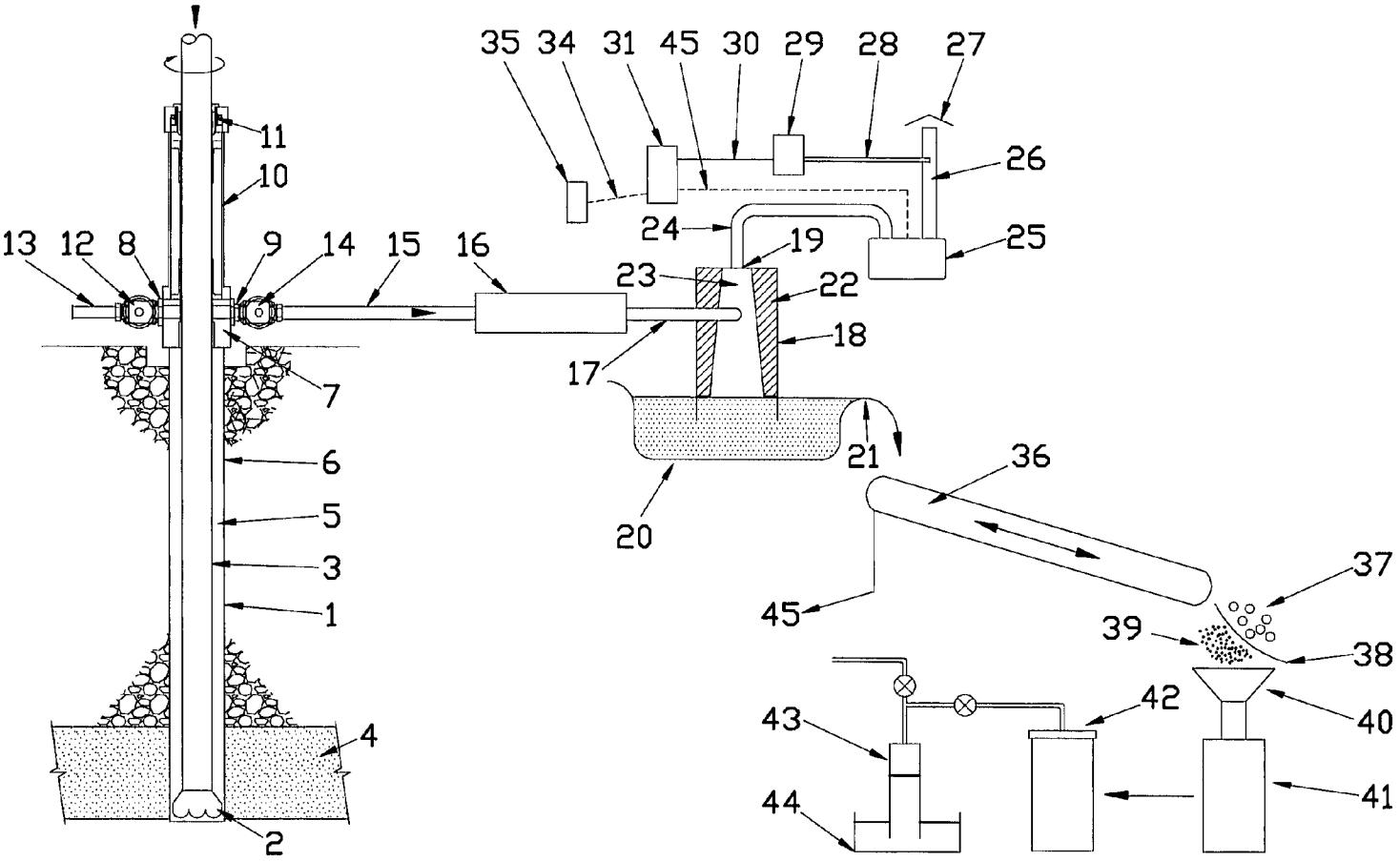
1
2
3
4
5
6
7
8
9
10
11
12
13
14
15
16
17
18
19
20
21
22
23
24
25
26
27
28
29
30
31
34
35
36
37
38
39
40
41
42
43
44
45
45

SYSTEM FOR ANALYSING GAS FROM STRATA BEING DRILLED UNDER HIGH MUD FLOWS

RELATED PATENT APPLICATIONS

This PCT application supplements PCT/AU200900403 application filed on 2 Apr. 2009, and also claims the further benefit of Australian provisional application 2009905663 filed on 19 Nov. 2009. This application provides an additional embodiment of the invention described in these previous applications.

TECHNICAL FIELD OF THE INVENTION

The present invention relates in general to hydrocarbon drilling operations, and more particularly to methods and apparatus for analysing gas desorbed in the drilling mud during the drilling operation.

BACKGROUND OF THE INVENTION

Mud logging has been used for a long time in petroleum drilling to determine the approximate location of gas bearing strata during the drilling process. In particular, mud logging involves the process of examining the drill cuttings extracted from the drilling mud to identify gas, hydrocarbon and other constituents which exist at the particular location of the drill bit. To that end, a gas detector is usually set up at the surface to sample the outflow of the drill mud from the borehole. This location is frequently above a shale shaker, but may be installed at other locations. The sampling equipment detects gases released from the drilling mud along with air that is drawn in by the sampling equipment. The system provides a qualitative analysis of the gases being released from the borehole. If the mud logging system monitors the progress of drilling operation and the drilling mud flow rate, it is possible to calculate the approximate location in the borehole where the gas was released. This process involves a calculation of up-hole velocity with time and its correlation with the output of the mud logger.

The conventional mud logging systems lack quantitative estimates of gas release volume because of the nature of the sampling process where air is drawn from above the mud in the belly of a shaker or some other area. In the case of a reservoir such as coal or shale where the gas is contained within the rock itself, the gas volume release can be expected to be directly related to the volume of rock drilled and directly related to the gas content of the coal on a volume per volume basis. This also applies to all the gas bearing sediments without large pore space such as vugs. In the latter case the gas release would be expected to extend beyond the drilled volume of the hole.

The usual method for obtaining gas constituents from coal seams is to core drill into the coal seam and pull the core as quickly as possible to the surface. The core is then removed from the core barrel and placed within a canister where desorption of the gas from the core sample is monitored. Invariably, gas is lost during the transit period from the depth of the coal seam to surface. This lost gas must be calculated from backwards extrapolation of the initial desorption rate of the core once it is placed in the canister, to the time at which it is considered that the coal commenced desorption. As the gas released from the core slows down, it is customary to open the canister and sample the core, then crush the sample to expedite the desorption process. The gas released from the crushed sample is measured and used in the analysis of the total gas content of the core sample. This measurement is usually specified as a gas volume per unit weight of coal.

The limitations of this technique involve the requirement to conduct a coring process to obtain a core sample, as well as the inaccuracies in the estimation of the initial gas lost to the atmosphere during the analysis procedure. It can be seen that a need exists for a process in which the analysis of the gas constituents can be obtained during a conventional drilling of the strata, where the drill mud with the cuttings therein is not exposed to the atmosphere, but is contained until the gas analysis is completed. Yet another need exists for a gas analysing system that is dynamic, meaning that the gas is continually accumulated and analysed.

SUMMARY OF THE INVENTION

The principles and concepts of the invention are especially applicable to the measurement of quantifiable total gas release from any borehole, but with particular reference to the measurement of gas release from strata such as coals or shales which contain the gas therein through the process of sorption. It also applies to conventional porous gas reservoirs with finer pore space and lower permeability where the gas released comes only from the drilled rock.

According to an important feature of the invention, the exploration for gasses in subterranean strata is facilitated by conducting a drilling operation which captures any gasses desorbed from the formation as well as from the cuttings generated by the drilling operation. The drill fluid, cuttings and desorbed gasses are coupled from the downhole location to the surface equipment which processes the gasses to determine desired parameters thereof. The retrieval of the desired gasses from the downhole location to the surface processing equipment is via a closed system which prevents the desorbed gasses from being diluted or otherwise contaminated by air and other environmental gasses. The desired parameters resulting from the processed desorbed gasses are thus more accurate and provide a better assessment of the gaseous nature of the strata.

According to another feature of the invention, the drilling process is continuous, except for interruptions during additions to the drill string, whereby the analysis and processing of the desorbed gasses with the surface equipment is ongoing and thus provides a dynamic record of the gas content of the strata being drilled. The length of the borehole, the rate of movement of the drill liquid upwardly in the annulus and other factors are used to determine the depth of the strata from which the analysed gasses were released.

In accordance with one embodiment of the invention, a seal is installed at the top of the wellbore casing to seal the drill string thereto. A port is situated below the seal so that the drilling fluid or mud (with the cuttings therein) returned from the bottom of the borehole is forced out through the port. Normally, the borehole being drilled would be drilled by open hole techniques rather than by coring. The seal would normally be of a rotary type to permit drilling by rotation of the drill string. The drill fluids carried out of the port contain drilling fluid, cuttings and gas released from both the formation and from desorption of the cuttings. If the mud pressure in the borehole exceeds the formation pressure then no formation fluids will enter the borehole. As a consequence, the only gas which would be liberated would be from the strata being drilled, and would be either from the direct release of gas contained within pore space, or from gas absorbed into the strata and released by desorption.

According to this embodiment of the invention designed to handle higher drilling fluid flow rates, the fluids passing from the port below the rotary seal are directed into an initial separator which separates the gas from the liquids and solids. The preferred embodiment of this initial separator is a large cyclonic device where the liquid level is held fairly static by having its base submersed in an open vessel with a fixed level overflow. The liquid and solid stream from the separator are run across a shale shaker (vibrating screen) or sieve bend which separates out the coarser size fraction of cuttings from the fines and drilling fluid. These coarser cuttings are then collected and desorbed in the conventional manner. This involves placing them in a canister and measuring the rate of gas release. When this process has slowed significantly the cuttings are removed, weighed and a fraction of them are pulverised to a small size so as to allow the residual gas to be released more quickly. The size fraction within the cuttings may then be measured so as to permit the diffusion characteristics of the material being drilled to be determined, and so that the gas lost in transit from the separator and across the shale shaker before a sample is contained in the desorption vessel may be calculated more accurately. The gas outlet from the separator is connected to a gas flow measuring system and preferably to a gas analysis system. This information is supplied to a data logging system which also records the drilling rate, bit position and fluid flow into and from the hole.

In order to precisely correlate the gas sample being analysed with a drilling depth, it is necessary to monitor the drilling process so that the depth and progress of drilling is monitored, as well as the drilling mud inflow or outflow rate. The location of the mud sample containing cuttings and gas bubbles can therefore be quite accurately determined. Such information is gathered by the data acquisition system.

The process of determining gas content of the formation being drilled from the apparatus is one where the gas volume released is measured and related to the position in the borehole from whence It is being cut, via analysis of drilling records. This involves knowing the position and penetration rate of the drill bit during drilling and having a record of the mud flow bringing chips to the surface. This information is used to derive a model of chips being cut and thereafter rising to the surface in the pumped fluid stream in the annulus. When pumping is not occurring consideration is given to chips settling in the annulus, and to the presence of rising bubbles in the drilling fluid. While this model can be kept simple or become complex, the basic information derived from it is to relate gas release to a specific strata being drilled. The process can be simplified–for example, by drilling a segment of one drill pipe length and flushing all chips to surface and analysing the same before stopping pumping. This assures that all of the information from the drilled zone is obtained before drilling recommences. The volume of gas released can be related to the volume of strata being drilled through a knowledge of the drill bit size and cutting diameter. This chip volume information should be refined where possible by obtaining a geophysical calliper log of the hole after it is drilled. Thus the basic information on the gas content of the strata is obtained as information on gas content per unit volume drilled. A geophysical log of the hole which includes a density log may be used to convert this information to the more customary unit of gas content per unit weight of the strata from whence it was released.

BRIEF DESCRIPTION OF THE DRAWING

Further features and advantages will become apparent from the following and more particular description of the preferred and other embodiments of the invention, as illustrated in the accompanying drawing.

FIG. 1 illustrates one embodiment of a well drilling system for analysing gas released from a borehole.

DETAILED DESCRIPTION OF THE INVENTION

FIG. 1 illustrates a downhole drilling operation of the type well adapted for analysing gasses obtained from a substrata coal seam. Over long periods of time, the coal seam absorbs or generates gasses which are contained in the coal material and its pores. It is to be understood that the principles and concepts of the invention can be employed in many other drilling situations and applications, including oil and gas shales, and other geological formations. The gas recovery and processing system shown in FIG. 1 illustrates a wellhead providing a closed system for recovering the drill liquid, cuttings and any desorbed gas from the down hole formation. The drill liquid, cuttings and desorbed gas are coupled from the wellhead in a closed separator system in which the gas is separated from the drill fluid and cuttings. The desorbed gas is then coupled to the gas processing equipment to determine predefined parameters, such as the extent of gas and/or the gas constituents in the formation being drilled.

According to the embodiment of the invention illustrated in FIG. 1, a borehole (1) is chilled by drill bit (2) that is attached to the end of a drill string (3). A conventional drill mud is forced under pressure by a mud pump (not shown) down the drill string (3). The drill bit (2) is rotated by either the drill string (3) or by a mud powered downhole motor (not shown). If a downhole motor is not used it is normal practise to plate a pressure relief/non return valve (not shown) behind the bit (2) to prevent fluid flow in the drill pipe (3) unless pumping takes place. The mud carries cuttings from the formation to the surface via the wellbore annulus (5). The borehole (1) is shown being drilled through a coal seam (4). The drilling operation produces coal cuttings which contain gas absorbed therein. The cuttings suspended in the drill mud rise up the annulus (5) between the drill string (3) and the borehole (1) and into the casing (6). Attached to the casing (6) is a diverter (7) with ports (8) and (9). Above the diverter (7) is an optional blowout preventer (10). A seal (11) is located above the blowout preventer (10). The seal (11) would normally be a rotary device through which the drill string (3) passes. The seal (11) prevents the escape of gasses desorbed from the drill mud during the upward travel from the bottom of the borehole (1) to the surface equipment. As used herein, the terms drill mud and drill fluid are interchangeable. The port (8) on the diverter (7) is shown connected to a valve (12) and pipe (13) which would normally be a kill line for well control. The other port (9) of the diverter (7) is shown connected to a valve (14) which is connected via a conduit (15) to a choke (16), shown as an annular adjustable pressure relief valve. A conduit (17) is connected to the outlet of the choke (16) and discharges the drilling fluid into a form of cyclonic separator (18). Within this separator (18) the drilling fluid is shown as a shaded area (22) rotating around and within the walls of the cyclonic separator (18) with a central section (23) containing only gas.

This has an upper outlet (19) to uptake the gas that is separated out of the fluid (23) while the lower portion Of the cyclone (18) is submersed in an open vessel (20) with an outlet (21). The outlet (21) maintains a relatively constant fluid level within the cyclonic separator (18). This relatively constant fluid level and volume within the cyclonic separator (18) means that the gas flow emitted from the outlet (19) is not affected significantly by fluid volume changes. The gas emitted from the cyclonic separator (18) flows out of the outlet (19) into conduit (24) to gas flow meter (25). This gas flow meter (25) is preferably of a positive displacement type capable of adding flow passing forwards through it and subtracting the value of any gas passing backwards through it. This enables the effects of liquid volume change within the cyclonic separator (18) and open vessel (20) to be minimised. After the flow meter (25), the gas passes into conduit (26) and to exhaust (27). The gas in the conduit (26) is sampled through conduit (28) by the gas analyser (29). The liquid containing cuttings (22) passes downwards within the cyclonic separator (18) into the open vessel (20) and out of ts overflow (21) into a solids removal system, shown here as a shale shaker (36). The larger separated particles (37) are shown leaving the shale shaker (36) and passing over a sieve (38) with a lesser size fraction (39) passing through into funnel (40) and into canister (41). Each canister is capped when filled with the material for which the gas content is desired to be measured and is desorbed conventionally by monitoring the gas release volume with respect to time. A simple system to do this is shown as a canister (42) connected to an inverted measuring cylinder (43) in a water bath (44). Other more automated systems could be adopted. When desorption has slowed, the canister (42) is opened and the mass of the chips is determined; some of this material is crushed to determine the residual gas content. It is also prudent to determine the particle size distribution of the chips so that the diffusion coefficient of the material of the chips may be determined, and so that an accurate estimate of the gas lost from cuttings can be made whilst they are in transit from the base of the cyclonic separator to being desorbed in the canister. Such a calculation may be made from the theory of diffusion utilising information on particle size and the time of transit. It is also wise to collect a sample from the underflow (45) of the shale shaker (36) so that the particle sizes and gas content of this finer material may be arrived at by a similar process to that of the coarser material, and so that comparisons of the gas contained from this fine material and the coarser material may be made. The process of determining the formation from whence the gas has come incorporates monitoring of the drilling depth, drilling mud flow, times of non flow and penetration rate and then calculating its likely source. The tools to do this include various drill monitors shown in the drawing as coming from a source (35). The information from the drilling source (35), the gas flow meter (25) and the gas analyser (29) are shown been conveyed via transmission systems (30), (34) and (45) to a data acquisition device (31).

It should be noted from the foregoing embodiments that it is preferable that the dynamic pressure at the downhole location is greater than the pressure in the formation being drilled. The reason for this is that any liquids in the formation are maintained in the formation and do not run into the borehole (1) to be combined with the drilling mud. This could alter the composition of the drilling mud to the extent that an accurate analysis of the gas would be hampered. This is accomplished by either maintaining the density of the drill mud or by adjusting the pressure of the drill mud forced downhole by the mud pump so that the pressure in the borehole (1) is always greater than the formation pressure. Sensors (not shown) attached to the well head can monitor the various pressures to adjust the pressure by which the mud pump operates or adjust a choke to maintain well bore pressure. It should also be appreciated that when the cuttings are smaller in size, the gas desorbed therefrom is expedited. This reduces the residence time in which the gasses are desorbed from the cuttings, thus allowing the same to be analysed more quickly. Those skilled in the art will understand how to conduct the drilling operation to obtain smaller cuttings, such as changing the rotary motion of the drill bit (2), using drill bits with teeth that make smaller chips, and other techniques.

While the analysis of the gas desorbed by the cuttings is considered continuous, it is noted that certain discontinuities may exist when a drill stem is added to the drill string (3). In order to minimise any change in the drill mud caused by atmospheric air or otherwise, it is preferred that a pressure relief valve (not shown) similar to a check valve be installed at the bottom of the drill stem, above the drill bit (2). With such a valve, when the mud pump is interrupted to install another drill stem to the drill string (3), the reduced pressure within the drill string (3) will allow the valve to close and maintain the downhole parameters at the status quo. In addition, the drill mud at the bottom of the borehole (1) will not tend to rise in the drill string (3). When the drill stem has been added to the string (3) and the mud pump commences operation, the pressure of the drilling mud within the drill string (3) will open the valve so that normal drilling can be continued. Care must also be exercised to ensure that air does not enter the drill string (3) while making up the swivel connection when drill stems are added to the string (3) and to ensure that the mud pump does not draw in air.

The foregoing describes the various embodiments in connection with the drilling in a coal seam. However, this is not a limitation of the invention as the principles and concepts of the invention can be employed with equal effectiveness with other types of formations, such as oil shale formations, gas shale formations and other formations where the presence of gas is suspected. In addition, while the different configurations of wellheads are disclosed in the various embodiments, it should be understood that many other different configurations can be employed with equal effectiveness, as long as the wellhead systems provide a closed system to prevent air from contaminating the desorbed gasses from the borehole formation. The various embodiments describe the use of a mud pit, however, a tank or other container-type reservoir can be used with equal effectiveness.

While the preferred and other embodiments of the invention have been disclosed with reference to specific drilling apparatus, separators and gas processing equipment, it is to be understood that many changes in detail may be made as a matter of engineering choices without departing from the spirit and scope of the invention, as defined by the appended claims.

What is claimed is:

1. A method of determining a gas volume per unit volume of subterranean borehole strata drilled by a drill pipe, and a non-coring drill bit of a known size connected at the bottom of the drill pipe, comprising:

drilling the borehole in a subterranean strata so that subterranean strata fluids do not flow into the borehole;

monitoring drilling parameters with respect to time so that a position of the drill bit within the subterranean strata is known;

monitoring a rate of a drilling liquid pumped down the drill pipe with respect to time, including periods of zero flow;

capturing all of the drilling liquid, released gas and cuttings at a well head without air contamination and transferring the drilling liquid, released gas and cuttings to a separator;

separating the gas and a mixture of drilling liquid and cuttings in the separator without air contamination;

measuring a volume of the separated gas released from the separator with respect to time using a gas flow metering system, and measuring the volume of gas released from the separator without requiring interruption of drilling the borehole;

returning the drilling liquid to a drilling fluid system for reuse by pumping down the drill pipe;

carrying out a calculation based upon drill bit position, borehole size, drill pipe size and mud flow rate history to determine a location within the borehole from which the cuttings and the gas emanating therefrom are derived; and carrying out a calculation to determine a gas volume released per unit volume of borehole drilled at various borehole depts.

2. The method of claim 1, further including separating the drilling liquid and cuttings using a shaker.

3. The method of claim 2, further including collecting the cuttings from the shaker and determining gas desorbed therefrom to find a gas volume thereof.

4. The method of claim 3, further including incorporating the volume of gas desorbed from the cuttings into the calculation of gas content per volume of borehole drilled.

5. The method of claim 1, further including utilising a seal between the drill pipe and the well head, and using a port in the well head below the seal and using a conduit to transfer the drilling liquid, released gas and cuttings from the borehole to the separator without air contamination.

6. The method of claim 1, further including using a closed separator of the type which prevents air contamination by having a wet base for mud and cuttings overflow, and said closed separator having a gas outlet to avoid air contamination.

7. The method of claim 1, further including utilising a measurement by calliper log following drilling to determine a diameter of the borehole.

8. The method of claim 1, further including utilising a measurement by density geophysical log to identify the strata drilled so that the gas content per unit mass can be calculated.

9. The method of claim 7, further including utilising a measurement by density geophysical log to identify the strata drilled so that the gas content per unit mass can be calculated to arrive at an accurate measurement of gas content per unit volume of strata.

10. The method of claim 1, further including analysing the gas separated from the drilling liquid and cuttings for gas composition.

11. Apparatus for measuring a gas content of a subterranean strata, comprising:

a drilling system for lowering a drill string and a non-coring drill bit from a well head and rotating the non-coring drill bit to form a borehole in the subterranean strata;

a drill mud circulating system for pumping drill mud down the drill string into the borehole, said drill mud circulating system for maintaining the borehole in a balanced or overbalanced pressure state;

a separator for separating gas from the drill mud and cuttings, said separator constructed so as not to permit air contamination therein, and said separator having a top exit port through which the separated gas exits for analysis thereof;

said separator constructed with an open base, and said open base is always submerged within liquid filling an open vessel during operation, and excess liquid overflows from said open vessel, whereby said open vessel maintains a relatively constant liquid level so as to maintain a constant volume within the separator;

a seal between the well head and the drill string, a port in said well head to transfer drilling liquid, cuttings and fluids flowing from the borehole to the separator without air contamination;

a measurement system for monitoring a depth of the drill bit so that a position thereof can be determined during drilling of the borehole;

said measurement system for monitoring a flow rate of the drill mud with time; and said measurement system for monitoring a volume of the gas as a function of time passing from the top exit port of said separator.

12. The apparatus according to claim 11, further including a shaker to separate drill mud from cuttings.

13. The apparatus according to claim 12, further including a canister for holding the separated cuttings to determine desorption of gas therefrom.

14. The apparatus according to claim 11, wherein the separator is constructed as a cyclonic form of separator, whereby said cyclonic separator includes a side tangential inlet, and a gas outlet located at a top of said cyclonic separator, and a liquid and cuttings discharge outlet at a base of said cyclonic separator.

15. The apparatus according to claim 11, further including a gas composition analyser for determining a composition of the gas passing through the top exit port of said separator.

16. A method of determining a gas volume per unit volume of subterranean strata drilled by a drill string of pipes, and a non-coring drill bit of a known size connected at the bottom of the drill string, comprising:

pumping a drill mud down the drill string to the drill bit and returning the drill mud with cuttings and desorbed gas to the surface in a closed drill system so that air does not contaminate gas desorbed from the cuttings;

measuring the depth of the drill bit in the subterranean strata as a function of time and measuring the volume of drilled subterranean strata drilled as a function of time;

coupling all of the drill mud, cuttings and desorbed gas and gas desorbed from the drilling mud while in transit to the surface to a separator where the desorbed gas is separated from the drill mud and cuttings and gas, and preventing air from contaminating the desorbed gas in the separator;

allowing the desorbed gas in the separator to continuously escape therefrom and pass through a gas flow measuring instrument to a) dynamically measure the volume of desorbed gas that is coupled to the separator without requiring interruption of drilling, and b) measure the desorbed gas that is separated from the cuttings in the separator without requiring interruption of drilling;

coupling the drill mud and cuttings from the separator to a shaker to separate the cuttings from the drill mud;

collecting the cuttings and analysing the gas desorbed from the cuttings; and using the gas volume measured by the gas flow measuring instrument and the gas desorbed from the cuttings together with the depth of the borehole and the volume of strata being drilled as a function of time to provide a record of the volume of gas released per volume of borehole drilled as a function of borehole depth.

17. The method of claim 16, further including using a separator having an open bottom submerged in a liquid filled vessel to assure a constant volume in said separator.

* * * * *